US005318197A

United States Patent [19]

Martindale et al.

[11] Patent Number: 5,318,197

[45] Date of Patent: Jun. 7, 1994

[54] METHOD AND APPARATUS FOR CONTROL AND MONITORING OF BEVERAGE DISPENSING

[75] Inventors: William A. Martindale; Richard A. Martindale, both of Vacaville; Matthew Straddeck, Davis, all of Calif.; Gregory J. Osborne, Reno, Nev.

[73] Assignee: Automatic Bar Controls, Vacaville, Calif.

[21] Appl. No.: 965,978

[22] Filed: Oct. 22, 1992

[51] Int. Cl.[5] ..... B67D 5/30

[52] U.S. Cl. ..... 222/1; 222/30; 222/36; 222/63; 222/504

[58] Field of Search ..... 222/1, 36, 37, 38, 25–28, 222/30, 640, 641, 504, 63; 235/94 R, 94 A

[56] References Cited

U.S. PATENT DOCUMENTS

| | | | |
|---|---|---|---|
| 3,170,597 | 2/1965 | Reichenberger | 222/36 |
| 3,257,034 | 6/1966 | Dumm, III | 222/36 |
| 3,463,363 | 8/1969 | Zelna | 222/504 X |
| 3,688,947 | 9/1972 | Reichenberger | 222/27 |
| 3,823,846 | 7/1974 | Probst | 222/641 |
| 3,845,883 | 11/1974 | Johnson et al. | 222/30 |
| 3,897,887 | 8/1975 | Goldberg | 222/26 |
| 3,920,149 | 11/1975 | Fortino et al. | 222/1 |
| 3,993,218 | 11/1976 | Reichenberger | 222/30 |
| 4,034,757 | 7/1977 | Glover | 222/36 X |
| 4,265,370 | 5/1981 | Reilly | 222/25 |
| 4,278,186 | 7/1981 | Williamson | 222/36 |
| 4,433,795 | 2/1984 | Maiefski et al. | 222/14 |
| 4,469,150 | 9/1984 | Grimaldi | 141/95 |
| 4,660,742 | 4/1987 | Ozdemir | 222/641 X |
| 5,044,521 | 9/1991 | Peckels | 222/23 |
| 5,255,819 | 10/1993 | Peckels | 222/1 |

FOREIGN PATENT DOCUMENTS

| | | | |
|---|---|---|---|
| 2548442 | 5/1977 | Fed. Rep. of Germany | B67D 5/22 |

*Primary Examiner*—Andres Kashnikow
*Assistant Examiner*—Anthoula Pomrening
*Attorney, Agent, or Firm*—Townsend and Townsend Khourie and Crew

[57] ABSTRACT

The invention provides a method for beverage dispensing control and monitoring. A bottle control cap is attached to a bottle and a micro processor positioned in the bottle control cap is programmed with data to identify that control cap from others in a system of programmable control caps. The micro processor controls an electric motor which opens and closes a flow passage in the control cap on command in response to a signal from a system control processor located at a remote location. The micro processor is also programmed to request the signal.

15 Claims, 5 Drawing Sheets

METHOD AND APPARATUS FOR CONTROL AND MONITORING OF BEVERAGE DISPENSING

BACKGROUND OF THE INVENTION

The present invention relates to the field of controlling and monitoring of liquid dispensing and more particularly to control, monitoring and reporting of drink dispensing in a bar or tavern or the like utilizing a system which includes self contained control caps on the beverage dispensing bottles coupled with a remote sensory and control processor useful to control, monitor and report the dispensing of the beverage.

The dispensing of expensive beverages, such as liquor, in a commercial establishment must be monitored and controlled to avoid waste and theft. Further, it is desirable to control the processing cycle to insure that the quantity of the liquor dispensed is accurate and repealable.

Measuring devices, such as an enlarged bottle cap having a spout which meters out one jigger of liquor and then stops, have been used to indicate both to the customer and the bartender that the measured quantity of liquor has been poured. Despite the fact that such devices do not monitor the relationship between the amount of liquor poured and the receipts therefor, these measuring devices provide a simplified, convenient, and somewhat reliable measuring device for both bartender and customer. These mechanical measuring devices are simply moved from an empty bottle to the next full bottle as needed. Since they are in use, they are somewhat accepted by customers and, to a lesser degree, the bartenders Automated systems for beverage control have been suggested. For example, U.S. Pat. No. 4,278,186 relates to a beverage dispensing control and quantity monitoring system which includes a transponder to transmit a signal from a control cap placed on a liquor bottle to a receiver system and then to a data processing device. The cap fits on the bottle and contains an electronic package which will meter the amount of beverage when tilted, thus controlling the amount poured. The cap also transmits to the receiver such data as the operator or bartender pouring the beverage, the type of beverage, the amount of beverage, and any other necessary data such as when the cap is removed form the bottle, when the battery therein is low, etc. This is accomplished using a plurality of data bits preprogrammed into each bottle cap which are serialized using a shift register. The serialized data gates the output of an LF oscillator. A separator HF signal transmitted from the vicinity of the bottle cap is mixed in a nonlinear device with the gated LF oscillator output and radiated to a remote receiver and data processing device.

Receiving and transmitting using HF signals in this manner however raises several problems. Depending on the establishment, the radio transmission may have to be licensed by the Federal Communications Commission which can prove to be a nuisance or impossibility to the establishment owner or operator. HF signals can be interrupted by transmissions emanating from ham radios, citizen band radios, limited transmit pagers, Police radios used inside the establishment, microwave dish reception used to bring in sport events and weather conditions such as lightning storms. Since there is no two way communication, the pour record would be lost if the processor receiver was disrupted.

Other problems associated with the prior art include opening a solenoid plunger to allow liquid flow in the traditional manner. The solenoid plunger relies on a spring to maintain a seal when the device is not in use. This spring is typically weak to allow for less power to operate, and this creates a problem. Bartenders wishing to circumvent the control may squeeze a plastic bottle and create sufficient pressure to lift the plunger and pour the beverage. Also, shaking the bottle can disrupt the seal and dispense product. Further, the power required to operate the solenoid is sufficient enough to preclude the use of small batteries as a power source thus creating the need for an external source such as an electro-magnet attached to a cable for constant power. Also shaking can be a problem when dispensing thick (sugar-based) products such as found in liqueurs. The sticky syrup does not flow well around the solenoid plunger and crystallizes causing the valve to stick.

There is still need for a liquid dispensing system which includes positive control of the dispensing from a remote processor and a cap controller that is responsive to such remote processor to accurately and reliably dispense a variety of liquors and maintain a record of such activity.

SUMMARY OF THE INVENTION

The present invention relates to a method for beverage dispensing control and monitoring and includes programming a micro processor positioned in a bottle control cap with data, including data to identify that control cap from others in a system of programmable control caps. The micro processor is also programmed to open and close a flow passage in the flow cap on command in response to a signal from a remote control processor located in a convenient position to receive and transmit signals from and to the control cap and to adjust the duration of the opening and closing to compensate for the difference in head pressure in the bottle to allow for a very accurate pour. The micro processor is also programmed to request the signal from the control processor when it is activated. Means are provided in the control cap to activate power means in the control cap to initiate a signal from the micro processor to the control processor.

The signal is received at the control processor and the control processor, when appropriate, returns a command signal to the micro processor including signals for opening and closing the flow passage to permit a predetermined flow of beverage from the bottle through the controller cap.

The present invention also provides a control cap having one end adapted for connection to a beverage bottle. A liquid flow passage is formed through the control cap and a valve is operably mounted in the controller cap to open and close the flow passage. An electric motor means is disposed in the control cap and is operably connected to the valve means for opening closing the flow passage to allow, and then terminate, flow therethrough. A battery pack is disposed in the control cap for powering the electric motor means and micro processor control means are located in the control cap for controlling the electric motor to operate the valve means to open and close the flow passage.

OBJECTS OF THE INVENTION

It is a particular object of the present invention to provide a reliable beverage dispensing control system which includes a plurality of control caps for various bottles used to dispense the beverages. It is also an object of the present invention to provide a control cap for use on the beverage dispensing bottles which includes a self-contained processor responsive to an external signal to control an electric power means to open and close a valve to permit flow of a predetermined amount of the beverage from the bottle. Further objects and advantages of the present invention will become apparent from the following detailed description read in view of the accompanying drawings which are made a part of this specification.

DESCRIPTION OF THE PREFERRED EMBODIMENT

Figure 1:
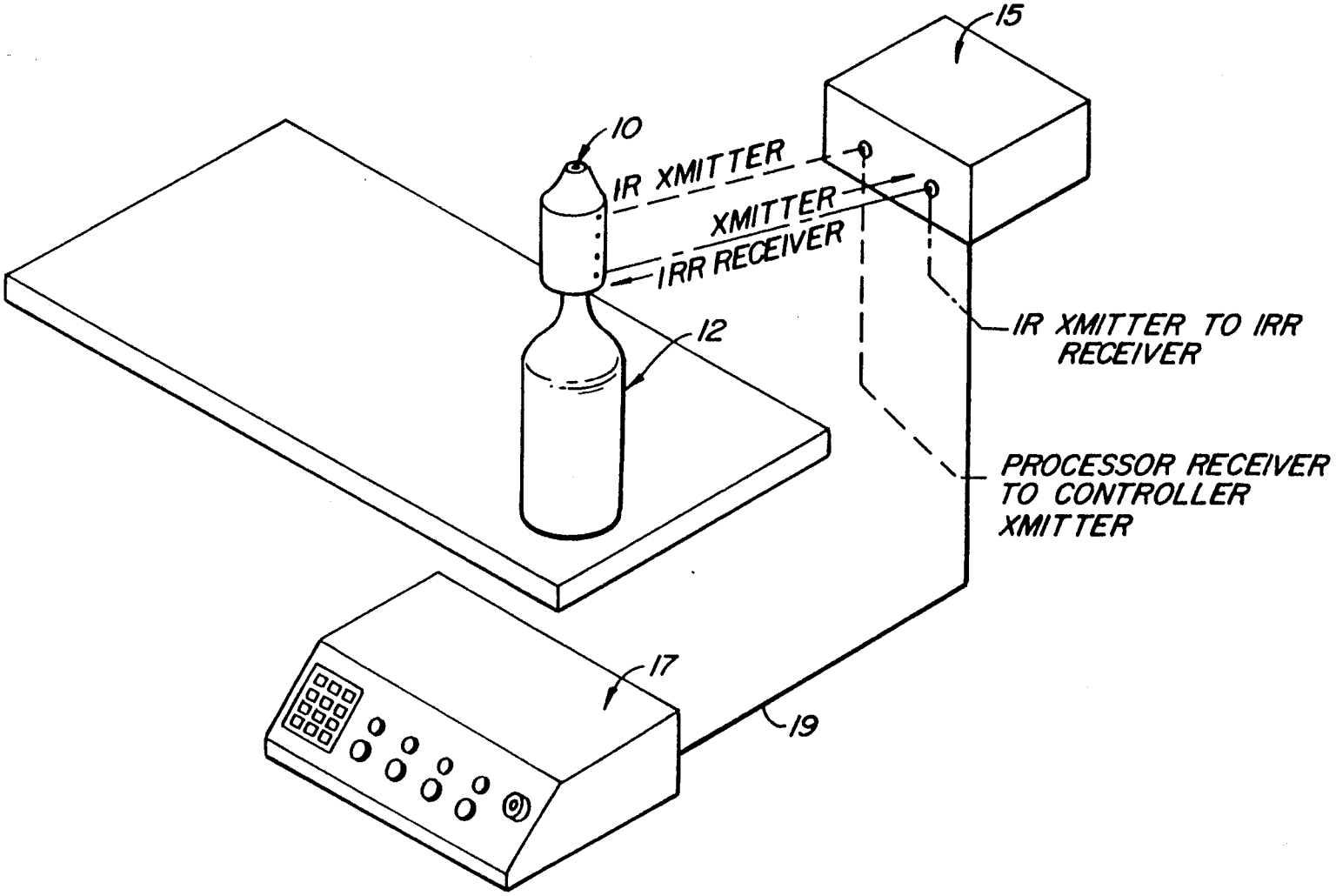
FIG. 1 is perspective schematic diagram showing the preferred beverage control system assembled in accordance with the present invention.

FIG. 1 is a perspective schematic view of the system showing a bottle 12 onto which is attached a control cap 10. The control system utilized with the control cap 10 includes a remote sensing device. For example, an infrared remote sensing device 15 capable of both receiving infrared signals from the control cap 10 and transmitting infrared signals back to the control cap 10 is shown schematically. The remote sensing device is connected to a control system processor 17 by suitable means such as cable 19. The system processor 17 is programmed both to receive information from a micro processor located in the control cap 10 via the remote sensor 15 and to transmit information back to the micro processor in the control cap 10.

As will be described in more detail below, the micro processor in control cap 10, when powered, is configured to provide both infrared transmission and infrared reception. A tilt sensor activates the micro processor when the bottle 10 is tilted to the pour position. The micro processor then provides data on bottle identification such as bottle location and brand of beverage to the system control processor via a remote sensor. The micro processor is also configured for controlling the pour cycle in the control cap 10 in response to a signal from the system control processor. The micro processor also activates signals for such events as the control cap 10 being taken off of the bottle, tampering with the control cap, control cap malfunction, optimum tilt angle of the bottle and low battery. The micro processor's infrared system is arranged to communicate with the remote sensor through 360°. The system processor 17 is programmed to control pour cycle time based on head pressure compensation, viscosity and density of a particular bottle, different pour sizes, repeat pour, complementary pour, and multiple pours from different bottles.

A simple pour sequence might, for example, be initiated when a bottle having a control cap 10 is inverted toward the pour position. A tilt sensor in the control cap activates a power source in the control cap to power the micro processor. The micro processor transmits a request to pour (along with the other data on bottle recognition and tilt angle) to the system control processor via the remote infrared sensor 15. The system control processor recognizes the particular liquid that is to be poured as well as the tilt angle of the bottle and transmits back to the micro processor the okay to pour along with time of pour. The micro processor receives the transmission and then causes the valving arrangement in the control cap to open, and after the predetermined time has passed, to close the valve to stop flow. The bottle may then be returned to the shelf. The system processor is capable of handling a multitude of bottles from several different bar stations. The system processor may also be programmed to provide reports on bar activities.

A repeat pour which may be included in the program of the system control processor allows the bartender to make multiple pours without having to turn the bottle upright between each pour. Repeat pour is entered if the bartender keeps the bottle in an inverted position for a programmable length of time after a pour has taken place. Once this time has been exceeded the controller will pour. Each subsequent repeat pour will take place at a programmable time interval. When multiple pours from different bottles are desired, then, almost simultaneously, the bartender pours from different bottles increasing the speed at which the bartender can operate. This feature allows two bottles to pour at what appears to be the same time. Substantially, simultaneous pouring is accomplished by processing the incoming messages from the controllers fast enough so that it appears that both messages were handled at the same time. In fact the messages are processed one at a time. If there is a collision in controller transmitted messages each controller will try to transmit again at different time intervals. This will ensure that the processor receives the messages one at a time.

Infrared transmission is especially beneficial because infrared communication provides a defined service area. Therefor, if a bottle is removed from the service area, it will not pour. Further, no FCC requirements need to be met. The distance of infrared communication in the bar establishment is very important. Longer distances between the scanner unit and the bottle controller are sometimes necessary because of the buildings' construction characteristics. A software communication program has been designed that enhances the systems' ability to communicate reliably over longer distances. This development is explained in detail herein. The data link between the processor 17 and the micro processor in control cap 10 utilizes an infrared bit serial communications technique. To minimize cost and maximize range and reliability a method to simulate Manchester code with software in place of the typical hardware solution was chosen. The main problem was with the pour station hardware. As it was required to have a realtime operating system, the use of the internal UART (Universal Asynchronous Receiver Transmitter) was required. Ordinarily external circuitry would convert the serial bit streams coming to and from the UART into Manchester code.

The approach of the invention was to program the UART to one stop bit and encode each byte (8 bits of data) into two bytes. Each byte to be transmitted is divided into two nibbles (4 bits) and then used as an index into a look up table that contains 16 unique bytes of data with their bits arranged in a manner such that when transmitted by the UART no more than two logical ones or two logical zeros are ever transmitted in sequence. Without this scheme, the possibility of 9 zeros or 9 ones could and would at times be transmitted in sequence. On the receiving end, each original byte is reconstructed from two received bytes. A CRC (Cyclic Redundancy Check) byte is encoded and appended to the transmitted stream to insure no errors have occurred in the data transfer. This technique when utilized with standard IR receiver and transmitter components approximately doubles the range of reliable communications. The extra software is small and fits in otherwise unused space in the processor firmware and does not add to the cost of each system.

Figure 2:
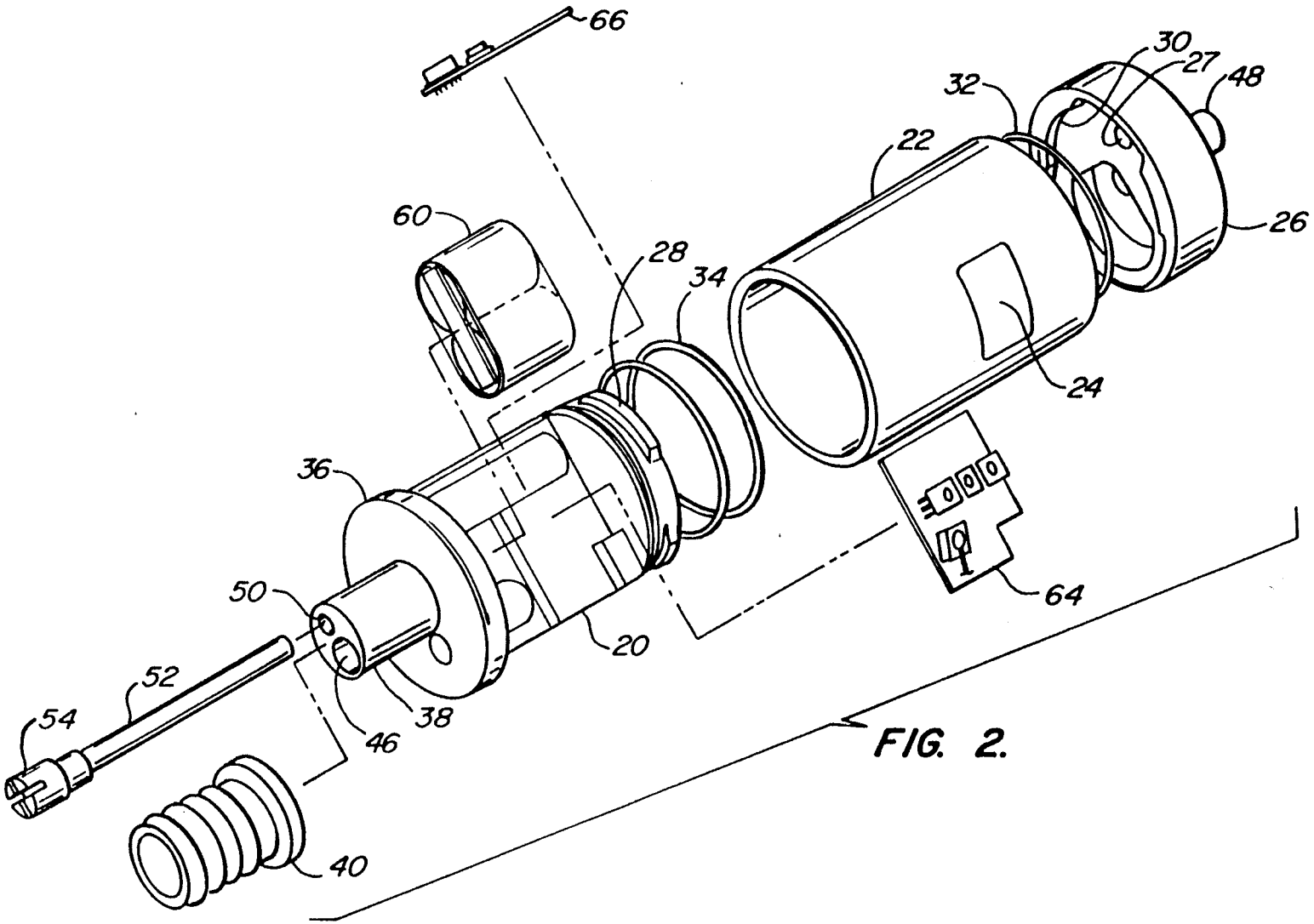
FIG. 2 is an exploded schematic view, with portions removed for clarity of presentation, of the preferred control cap of the present invention.
Figure 3:
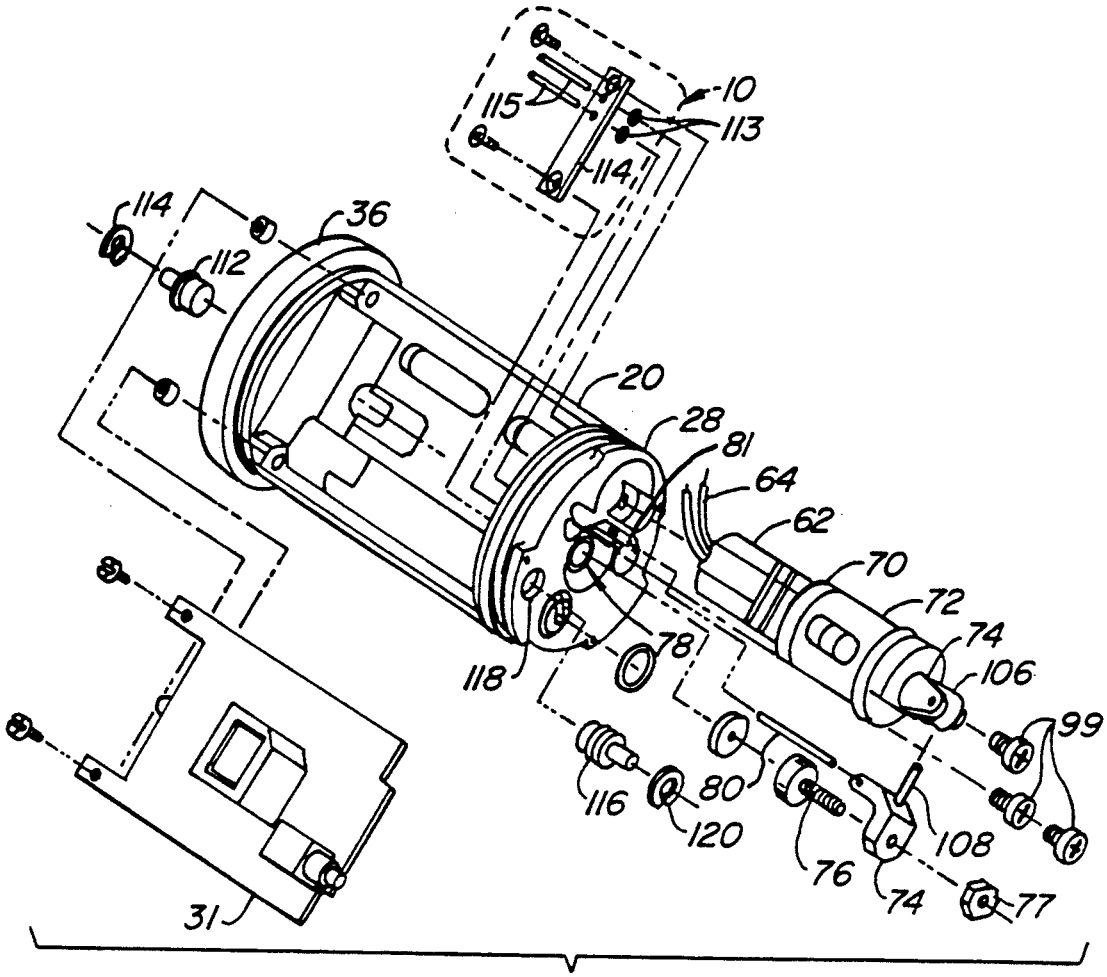
FIG. 3 is an exploded schematic view, with additional portions removed for clarity of presentation, of the preferred control cap of the present invention.
Figure 4:
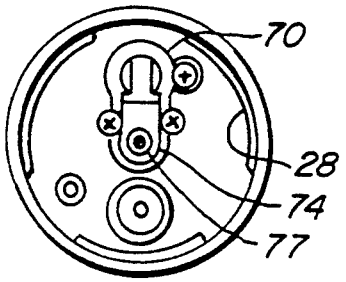
FIG. 4 is a top view of the control cap of FIG. 3 as assembled.

FIGS. 2 and 3 are schematic exploded views illustrating the preferred control cap generally indicated as 10 of the present invention. Parts are removed from both figures for ease in this description. Common parts are indicated by the same number in all figures. FIG. 4 is a top view of the control cap of FIG. 3 as assembled. The control cap 10 includes a core member 20 having several compartments or void spaces therein. These compartments are used to hold various components used in pouring the beverage from a bottle in accordance with the invention. A sleeve 22 is sized to slidably fit over the core member 20. Clear windows, such as window 24, are provided at suitable locations on the core sleeve 22 so that signals from inside the core member may be viewed when the control cap is in operation.

A core cap 26 is adapted to be connected to the pour end of the core member 20 using interlocking flanges 28 and 30. Suitable o-rings 32, 34 seal the connection between the core cap 26 and the core member 20. The other end of the core member is provided with a flange 36 on which the bottle end of the sleeve 22 abuts in operating position. This portion of the core member 20 has an external extension 38 which is tapered to accept a bottle adapter 40 for realizingly fitting inside the bottle neck.

The bottle end of the core member 20 has three ports. The first port 46 provides a flow passage for flow of liquid from the bottle through the interior of the core member 20 and out of the pour spout 48 of the core cap 26. The second port 50 is sized to receive a breather assembly 52 which connects into the flow passage of the core member 20. The open end 54 of the breather assembly is inserted into the bottle when the control cap is attached to permit air to enter the lower portion of the bottle as liquid flows out. The third port 56 in the core member is provided to receive a plunger switch used to indicate when the control cap is removed from a bottle. The core cap 26 is also provided with a port 27 for a plunger switch. The function of the plunger switches will be described in detail below.

The core member 20 has several compartments or void spaces adapted to hold various components in accordance with the preferred arrangement of the present invention. Thus, a battery compartment in the core member is sized to hold battery pack 60. The battery pack 60 is connected to the electric motor 62 through a motor controller by suitable means such as wires 64. A power reset mechanism 66 is fitted into the core member 20 and is connected to the battery pack 60 to conserve batter power by powering up only the parts of the controller that are necessary. A hardware timer periodically wakes up the microprocessor. If the microprocessor senses that the bottle has been inverted, then it powers up the rest of the controller. Otherwise, the processor puts itself "back to sleep".

As shown in FIGS. 3 and 4, an actuator assembly indicated generally as 70 includes a motor 62, an actuating cylinder 72, and an actuator lead screw **74*a*. The actuating assembly is connected to a flapper valve assembly which includes flapper valve pivot 74 and valve stem and stopper 76. The end of the valve stem is threaded for connection with a suitable hex nut 77 for adjustable mounting on the valve pivot 74. The valve pivot 74 is mounted adjacent to the flow passage port 78 formed in the pour end of the core member 20. A dowel pin 80 is inserted in the hole provided in the valve pivot 74 and is connected into seat 81 provided in the core member 20 so that the flapper valve pivot can rotate on the pin to open and close the flow passage port when moved by the actuator assembly 70**.

Figure 5:
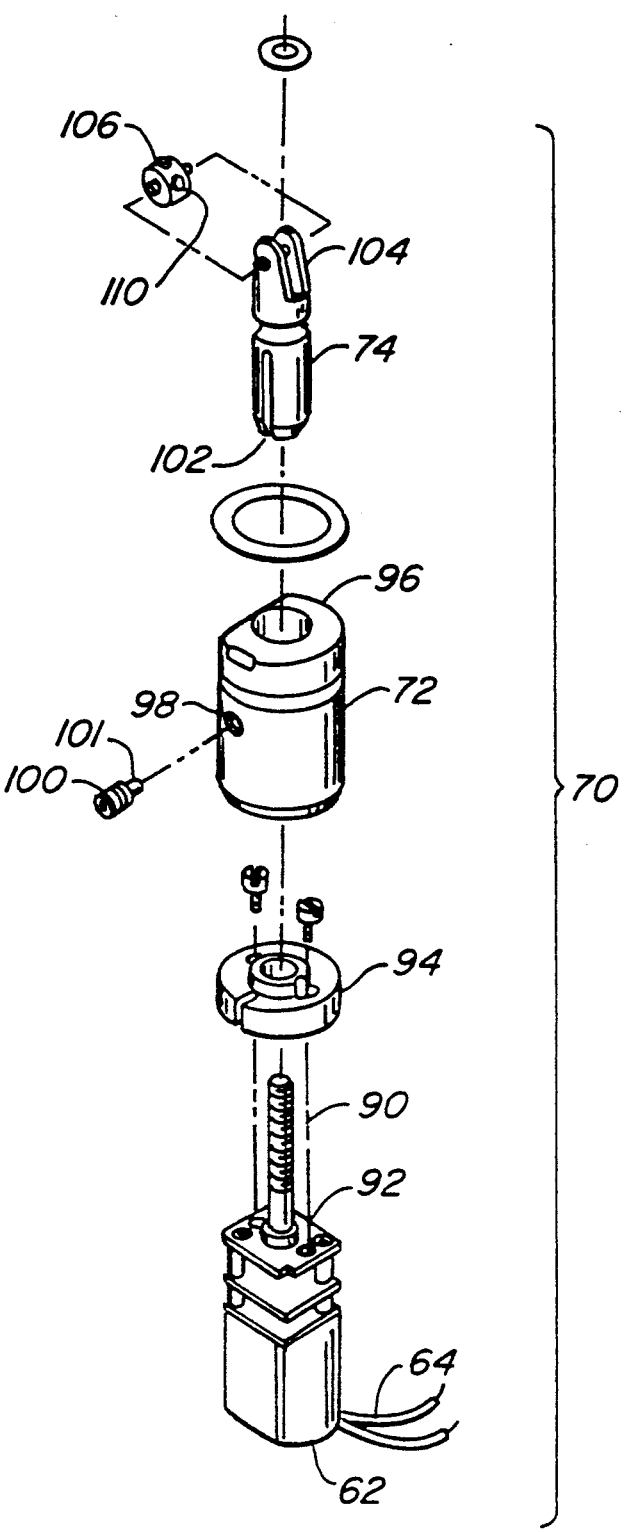
FIG. 5 is an exploded schematic view of the preferred control cap actuator assembly configured in accordance with the present invention.

The actuator assembly 70 is shown in greater detail in the exploded view of FIG. 5. The electric motor 62 is preferably of the mini geared type commonly used in the automatic focus mechanism of cameras. A suitable motor has been found to be Model LA126-344 of the Copal Company Limited. The gear box on the motor 62 was modified for use in the present invention to provide the desirable gear ratio. The gear reduction important because it allows control of the (typically) high speed of the electric motor. The slower (reduced) speed offers two advantages; (1) the motor 62 and threaded shaft mechanism do not jam because of high RPM, and the gear reduction increases torque which makes the small motor very powerful. This power allows the flapper valve to pull up from the seat so that liquid will dispense, even with thick liqueur. Additionally, the gear reduction mechanism closes the flapper with such torque, the bartender cannot shake beverage from the bottle nor squeeze plastic containers to dispense product.

The motor 62 uses so little power to accomplish the opening and closing of the flapper that a small battery pack can provide sufficient power to pour over three hundred liter bottles of beverage and allow for a bottle controller to be affixed to the bottle while requiring no external power.

The electric motor 62 is provided with a threaded shaft 90 which is engaged in mating threads formed in the interior of the actuator lead screw **74*a* for reciprocal movement therein. A base plate 92 is fixedly connected to the motor 62 and is adapted to seat and connect adaptor plate 94 by suitable screws as shown. An actuating cylinder 72 is provided with a smooth bore 96 for slidably receiving the lower portion of the actuator lead screw 74*a*. A side port 98 is located in position so that the smooth end portion 101 of set screw 100 slidably engages the slot 102 in the actuator lead screw 74*a* to prevent rotation of the actuator lead screw as it reciprocates in and out of the actuating cylinder. Thus, the adapter lead screw 74*a* can be reciprocated up and down in the smooth bore 96 of the actuator cylinder 72** by operating the electric motor and reversing the electric motor.

The upper end of the actuator lead screw **74*a* is fitted with a yoke 104 having slots adapted to movably hold the pin extensions of pivot actuator 106. The dowel pin extension 108 of valve pivot 74 slidably engages in the hole 110 located in the pivot actuator 106. Thus, when the motor 62 rotates shaft 90 in one direction, the actuator lead screw moves down in the bore 96 of actuator cylinder 72 causing the valve pivot 74 to rotate about dowel pin 80 to thus open flow passage 78 to permit liquid flow. When electric motor 62 is reversed, the actuator causes the valve pivot to seal the valve to close the flow passage 78** to liquid flow.

Referring again to FIGS. 3 and 4, a plunger switch 112 is adapted to be positioned by lock ring 114 in port 56 (FIG. 2) in the bottle end of the core member 20. The plunger switch is connected to the micro processor unit 31 to cause a signal to be activated when the control cap is unseated from the bottle as more fully described. A second plunger switch 116 is adapted to be positioned in port 118 of the core member 20 by a suitable retaining ring 120. The second plunger switch is connected to the micro processor unit 31 to cause a signal if the core cap 26 is removed from the control cap.

The control cap of the present invention uses an electronic lock which activates a small light (light emitting diode) to alert management if tampering has occurred. This approach significantly improves prior means because management no longer must check labels for breakage nor re-apply labels to new bottles as must be done when using. Each controller cap sends a different identification signal to the scanner so that the system can determine the exact brand and type of liquor being poured. The system software of the present invention is programmed to deduct the drinks dispensed from the remaining liquid in the bottle and to compensate for this change, automatically, by allowing the flapper valve to remain open milli-seconds longer, after each pour, which maintains a high degree of accuracy.

Figure 6C:
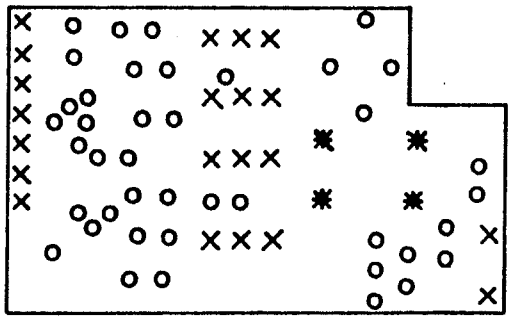
FIG. 6 is a circuit board diagram of the micro processor used in the preferred embodiment of the control cap.
Figure 6B:
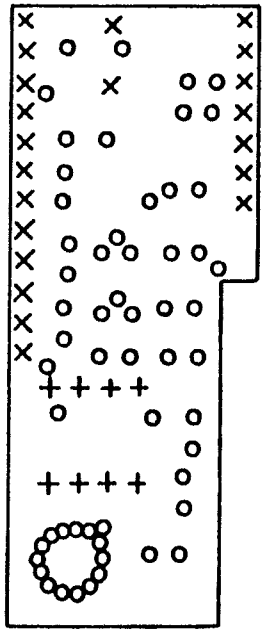
Figure 6A:
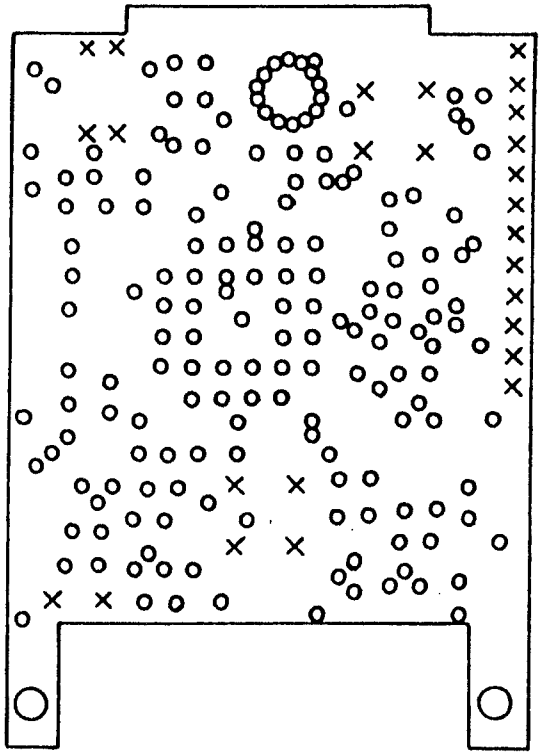

A fluid detection sensor assembly detects when the bottle is empty. If the bottle empties during a pour, then the pour can be finished with another bottle. If the bottle empties during a pour, the controller tells the processor that the bottle is empty and gives it the amount of time left to pour. Then when a bottle of the same brand is inverted, the processor gives the controller the remaining time to pour. The controller detects the presence, of liquor using two stainless steel sensor pins 115 sealed by rings 113, and held in place by plate 14. To detect liquor, a voltage potential is placed on the sensor pins. If liquor is present, it will bridge the sensor pins allowing current to flow. This current flow is detected by the microprocessor indicating that liquor is present. The microprocessor in the control cap is responsible for making all decisions for proper controller operation. Also, the microprocessor manipulates all other controller hardware to perform all controller functions including infrared communication, motor control, tilt detection, liquor detection, battery level detection, LED control and power control. The printed circuit board shown in FIG. 6 in three pieces to reduce overall controller size, and to provide a means of detecting the tilt angle in three dimensions.

Having described the presently preferred embodiments of the invention, it should be understood that various changes in construction and arrangement will be apparent to those skilled in the art and are fully contemplated herein without departing from the true spirit of the invention. Accordingly, there is covered all alternatives, modifications and equivalents as may be included within the spirit and scope of the invention as defined in the appended claims.

What is claimed is:

1. A method for beverage dispensing control and monitoring comprising attaching a bottle control cap to a bottle, said control cap including a micro processor positioned in said bottle control cap containing data to identify that control cap from others in a system of programmable control caps; said micro processor being programmed to open and close a flow passage in said control cap in response to an infrared command signal from a system control processor located at a remote location, said micro processor being also programmed to request said command signal; activating power means in said control cap to activate said microprocessor to initiate an infrared request signal from said micro processor to said system control processor; and receiving the infrared request signal at the system control processor and returning the command signal to said micro processor including signals for opening and closing the flow passage in said control cap to permit a predetermined flow of beverage from said bottle through the control cap.

2. The method of claim 1 where tilting of the bottle activates said power means.

3. The method of claim 1 further characterized in that the micro processor activates an electric motor to open and close said flow passage.

4. The method of claim 3 further characterized in that the micro processor is programmed to repeat an opening and closing of said flow passage when the bottle remains tilted for a predetermined time.

5. The method of claim 1 further characterized by programming the system control processor to handle pouring from a plurality of bottle control caps.

6. A control cap having a liquid flow passage therethrough and one end adapted for connection to a beverage bottle and the other end adapted to pour a beverage comprising a core member, a flapper valve means operably mounted in said core member to open and close said flow passage; electric motor means having a gear reduction means disposed in said core member operably connected by linkage means including a threaded shaft to said flapper valve means for moving said flapper valve means in response to rotation of said threaded shaft to open and close said flow passage; a battery pack in said core member for powering said electric motor means; and control means in said core member for controlling said electric motor means to rotate said threaded shaft to operate said flapper valve means to open and close said flow passage.

7. A control cap for use on a bottle comprising: a core member having voids formed therein and a flow passage for liquids therethrough; a sleeve slidably fitting over said core member; a bottle adapter connected to one end of said core member for connecting said core member to a bottle; a core cap having a flow outlet connected to the other end of said core member; said flow passage formed through both said core member and said core cap to enable liquid to flow from said bottle adapter through said core member and out of the flow outlet of said core cap; a flapper valve adapted to open and close said flow passage to flow of liquids; means pivotally mounting said flapper valve in said core member adjacent to said flow passage; electric motor means mounted in said core member; a battery pack operably connected to said electric motor means; linkage means included a threaded shaft operably connected between said electric motor means and said flapper valve to move said flapper valve to selectively open and close said flow passage; a micro processor in said core member operably connected to said electric motor means and to said battery pack for receiving power therefrom for controlling said electric motor means; said micro processor being programmed to control said electric motor means in response to an external signal generated outside of the control cap to rotate said threaded shaft to operate said flapper valve to open and close said flow passage; and a tilt sensor means in said core member for activating said micro processor when said bottle is in position to pour.

8. The control cap of claim 7 further characterized by a remote processor means programmed to receive signals from said micro processor in said control cap and to return control signals to said micro processor.

9. A system for beverage dispensing control and monitoring comprising a system control processor; a bottle control cap for attachment to a bottle, said control cap containing a micro processor identifying that control cap from others in a system of programmable control caps, said micro processor programmed to open and close a flow passage in said control cap in response to a command signal from the system control processor located at a remote location and to send a request signal to said system control processor requesting said command signal; power means in said control cap responsive to said micro processor to open and close the flow passage in said control cap to permit a predetermined flow of beverage from said bottle through the control cap; and means receiving the request signal at the system control processor and returning the command signal to said micro processor including signals for opening and closing the flow passage in said control cap to permit a predetermined flow of beverage from said bottle through the control cap.

10. A method for beverage dispensing control and monitoring comprising attaching a bottle control cap to a bottle, said control cap containing a micro processor positioned in said bottle control cap identifying that control cap from others in a system of programmable control caps; said micro processor being programmed to open and close a flow passage in said control cap in response to a command signal from a system control processor located at a remote location, said micro processor being also programmed to request said command signal; activating power means in said control cap to activate said microprocessor to initiate a request signal from said micro processor to said system control processor requesting said command signal from said system control processor; and receiving the request signal at the system control processor and returning the command signal to said micro processor including signals for opening and closing the flow passage in said control cap to permit a predetermined flow of beverage from said bottle through the control cap.

11. The method of claim 10 where tilting of the bottle activates said power means.

12. The method of claim 10 further characterized in that the micro processor activates an electric motor to open and close said flow passage.

13. The method of claim 12 further characterized in that the micro processor is programmed to repeat an opening and closing of said flow passage when the bottle remains tilted for a predetermined time.

14. The method of claim 10 further characterized by programming the system control processor to handle pouring from a plurality of bottle control caps.

15. A control cap for use on a bottle comprising: a core member having voids formed therein and a flow passage for liquids therethrough; a sleeve slidably fitting over said core member; a bottle adapter connected to one end of said core member for connecting said core member to a bottle; a core cap having a flow outlet connected to the other end of said core member; said flow passage formed through both said core member and said core cap to enable liquid to flow from said bottle adapter through said core member and out of the flow outlet of said core cap; a flapper valve adapted to open and close said flow passage to flow of liquids; means pivotally mounting said flapper valve in said core member adjacent to said flow passage; electric motor means mounted in said core member; a battery pack operably connected to said electric motor means; linkage means operably connected between said electric motor means and said flapper valve to move said flapper valve to selectively open and close said flow passage; a micro processor in said core member operably connected to said electric motor means and to said battery pack for receiving power therefrom for controlling said electric motor

* * * * *